US011969031B2

(12) United States Patent
Luong

(10) Patent No.: US 11,969,031 B2
(45) Date of Patent: Apr. 30, 2024

(54) HYBRID ARTICLE OF APPAREL

(71) Applicant: NIKE, Inc., Beaverton, OR (US)

(72) Inventor: John Luong, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 324 days.

(21) Appl. No.: 15/486,533

(22) Filed: Apr. 13, 2017

(65) Prior Publication Data

US 2017/0318868 A1 Nov. 9, 2017

Related U.S. Application Data

(60) Provisional application No. 62/331,135, filed on May 3, 2016.

(51) Int. Cl.

| | |
|---|---|
| ***A41D 1/08*** | (2018.01) |
| ***A41D 1/06*** | (2006.01) |
| ***A41D 27/24*** | (2006.01) |

(52) U.S. Cl.

CPC ..... *A41D 1/08* (2013.01); *A41D 27/245* (2013.01); *A41D 2400/24* (2013.01); *A41D 2600/10* (2013.01)

(58) Field of Classification Search

CPC .... A41D 27/245; A41D 2600/10; A41D 1/14; A41D 7/00; A41D 1/08; A41D 2400/24

See application file for complete search history.

(56) References Cited

U.S. PATENT DOCUMENTS 1,104,632 A * 7/1914 Cowen ..... A41D 1/14 2/212
1,121,177 A * 12/1914 Forbes ..... A41D 7/00 2/67
1,248,562 A * 12/1917 Shulhof ..... A41D 7/00 2/67
1,476,248 A * 12/1923 Green ..... A41D 7/00 2/67
1,561,252 A 11/1925 Laster
1,747,562 A * 2/1930 Wellstatter ..... A41B 9/08 2/212
1,966,060 A * 7/1934 Cohen ..... A41B 9/04 2/404
2,034,312 A 3/1936 Rubin
2,091,441 A * 8/1937 Hauser ..... A41D 7/00 2/212

(Continued)

FOREIGN PATENT DOCUMENTS

CN 202588378 U 12/2012
DE 2134219 A1 1/1973

(Continued)

OTHER PUBLICATIONS

International Search Report and Written Opinion dated Jul. 24, 2017 in International Patent Application No. PCT/US2017/030797, 16 pages.

(Continued)

*Primary Examiner* — Katharine G Kane

(74) *Attorney, Agent, or Firm* — Shook, Hardy & Bacon L.L.P.

(57) ABSTRACT

A hybrid article of apparel is provided. The article comprises a form-fitting inner layer and a looser, more freely-fitting outer layer joined together at various locations to provide an aerodynamic article with improved modesty, among other benefits.

10 Claims, 7 Drawing Sheets

(56) References Cited

U.S. PATENT DOCUMENTS

| | | | | | |
|---|---|---|---|---|---|
| 2,325,924 | A * | 8/1943 | Trent | A41D 1/06 | 2/227 |
| D137,924 | S | 5/1944 | Brodigan | | |
| 2,358,113 | A * | 9/1944 | Solomon | A41D 7/00 | 2/212 |
| 2,580,774 | A * | 1/1952 | Helbig | A41D 1/06 | 2/212 |
| 2,599,769 | A | 6/1952 | Macrae et al. | | |
| 2,613,363 | A * | 10/1952 | Morgan | A41D 15/02 | 2/212 |
| 2,617,112 | A * | 11/1952 | Neilson | A41B 9/04 | 2/407 |
| 2,659,893 | A | 11/1953 | Hindman | | |
| 3,399,679 | A * | 9/1968 | Barg | A41B 9/08 | 2/71 |
| 3,678,514 | A | 7/1972 | Safrit | | |
| 3,750,193 | A * | 8/1973 | Cooke | A41F 9/025 | 2/237 |
| 3,835,866 | A * | 9/1974 | Brooks | A41C 1/003 | 450/123 |
| 3,961,376 | A * | 6/1976 | Howell | A41D 15/00 | 2/71 |
| 4,041,736 | A | 8/1977 | Fregeolle | | |
| D261,323 | S | 10/1981 | Catron | | |
| D266,540 | S * | 10/1982 | Nacinovich | D2/738 | |
| 5,068,920 | A | 12/1991 | Bray | | |
| 5,136,727 | A | 8/1992 | Brisco | | |
| D350,845 | S | 9/1994 | Mahan | | |
| D378,317 | S * | 3/1997 | Wike | D2/712 | |
| 5,689,832 | A | 11/1997 | Head | | |
| 5,704,071 | A * | 1/1998 | Barclay | A41D 1/08 | 2/238 |
| 5,806,100 | A * | 9/1998 | De Scandiffio | A41D 1/14 | 2/211 |
| 6,550,288 | B2 | 4/2003 | Browder, Jr. et al. | | |
| 6,665,882 | B1 * | 12/2003 | Pedrick | A41D 7/005 | 2/228 |
| 7,631,366 | B2 * | 12/2009 | Oyama | A41C 1/003 | 2/228 |
| 7,735,155 | B2 * | 6/2010 | Kerkhoff | A41D 1/14 | 2/114 |
| 7,849,522 | B2 | 12/2010 | Roux | | |
| 8,123,590 | B2 | 2/2012 | MacKinnon | | |
| 9,380,818 | B2 * | 7/2016 | Tippett | A41D 15/002 | |
| 2004/0107479 | A1 | 6/2004 | Dicker et al. | | |
| 2006/0216454 | A1 * | 9/2006 | Heil | A41D 27/245 | 428/57 |
| 2009/0083894 | A1 | 4/2009 | Causey-Gabbe | | |
| 2011/0070796 | A1 * | 3/2011 | Renzo | A41D 27/245 | 442/183 |
| 2011/0209267 | A1 | 9/2011 | Rush et al. | | |
| 2012/0090076 | A1 | 4/2012 | Kenney et al. | | |
| 2012/0117714 | A1 | 5/2012 | Peck et al. | | |
| 2012/0227164 | A1 * | 9/2012 | Komoriya | A41B 9/12 | 2/400 |
| 2013/0014311 | A1 | 1/2013 | Chapuis | | |
| 2013/0153131 | A1 * | 6/2013 | Ozawa | A41D 27/24 | 156/227 |
| 2014/0101826 | A1 | 4/2014 | Nearman | | |
| 2014/0310854 | A1 * | 10/2014 | Kianmahd | A41D 1/06 | 2/237 |
| 2015/0107000 | A1 | 4/2015 | Tanaka et al. | | |
| 2015/0128331 | A1 | 5/2015 | Grosse | | |
| 2016/0007662 | A1 | 1/2016 | Powell | | |
| 2016/0295933 | A1 * | 10/2016 | Herbener | A41D 27/20 | |

FOREIGN PATENT DOCUMENTS

| | | | |
|---|---|---|---|
| JP | 3141647 | U | 5/2008 |
| KR | 20-0385129 | Y1 | 5/2005 |
| WO | 2013153624 | A1 | 10/2013 |

OTHER PUBLICATIONS

"prAna Clothing," Sierra Trading Post, Inc., sierratradingpost.com, accessed: Sep. 2015. http://www.sierratradingpost.com/prana~b~16299/.

"Exercise Leggings With Skirt Attached," Safe Diet, aqeela.net, 2013. http://www.aqeela.net/tag/exercise-leggings-with-skirt-attached.

Kurcfeld, Diana Dibble, "Exercising in Skirts," The Reign of Color, hydrochic.com, Mar. 25, 2014. http://www.hydrochic.com/blog/exercising-in-skirts/.

Well+Good, "Workout leggings that cover your back(side)," Was Fat Now Fit, wasfatnowfit.co.uk, Jan. 22, 2013. http://www.wasfatnowfit.co.uk/workout-leggings-that-cover-your-backside/.

International Preliminary Report on Patentability dated Nov. 15, 2018 in International Patent Application No. PCT/US2017/030797, 9 pages.

Communication pursuant to Article 94(3) dated Nov. 29, 2019 in European Patent Application No. 17723600.7, 4 pages.

Intention to Grant received for European Patent Application No. 17723600.7, dated Sep. 16, 2020, 6 pages.

Extended European Search Report received for European Patent Application No. 21158591.4, dated Jun. 14, 2021, 7 pages.

Intention to Grant received for European Patent Application No. 21158591.4, dated Apr. 28, 2023, 6 pages.

* cited by examiner

HYBRID ARTICLE OF APPAREL

CROSS-REFERENCE TO RELATED APPLICATIONS

This application claims priority to co-pending U.S. Provisional Patent Application No. 62/331,135, filed May 3, 2016, and titled "Hybrid Article of Apparel," the contents of which are incorporated herein by reference in its entirety.

TECHNICAL FIELD

The field relates to apparel.

BACKGROUND

Articles of apparel often require different characteristics to satisfy the needs of a wearer. Sometimes articles of apparel with aerodynamic properties are close-fitting, and provide only limited modesty for the wearer. As a result, a form-fitting article with additional features that provide improved modesty, functionality, and aesthetics, among other characteristics, is needed.

BRIEF DESCRIPTION OF THE DRAWINGS

The present technology is described in this disclosure with reference to the attached drawing figures, which are incorporated by reference, and which are intended to be exemplary and non-limiting in nature, wherein.

DETAILED DESCRIPTION

Figure 1:
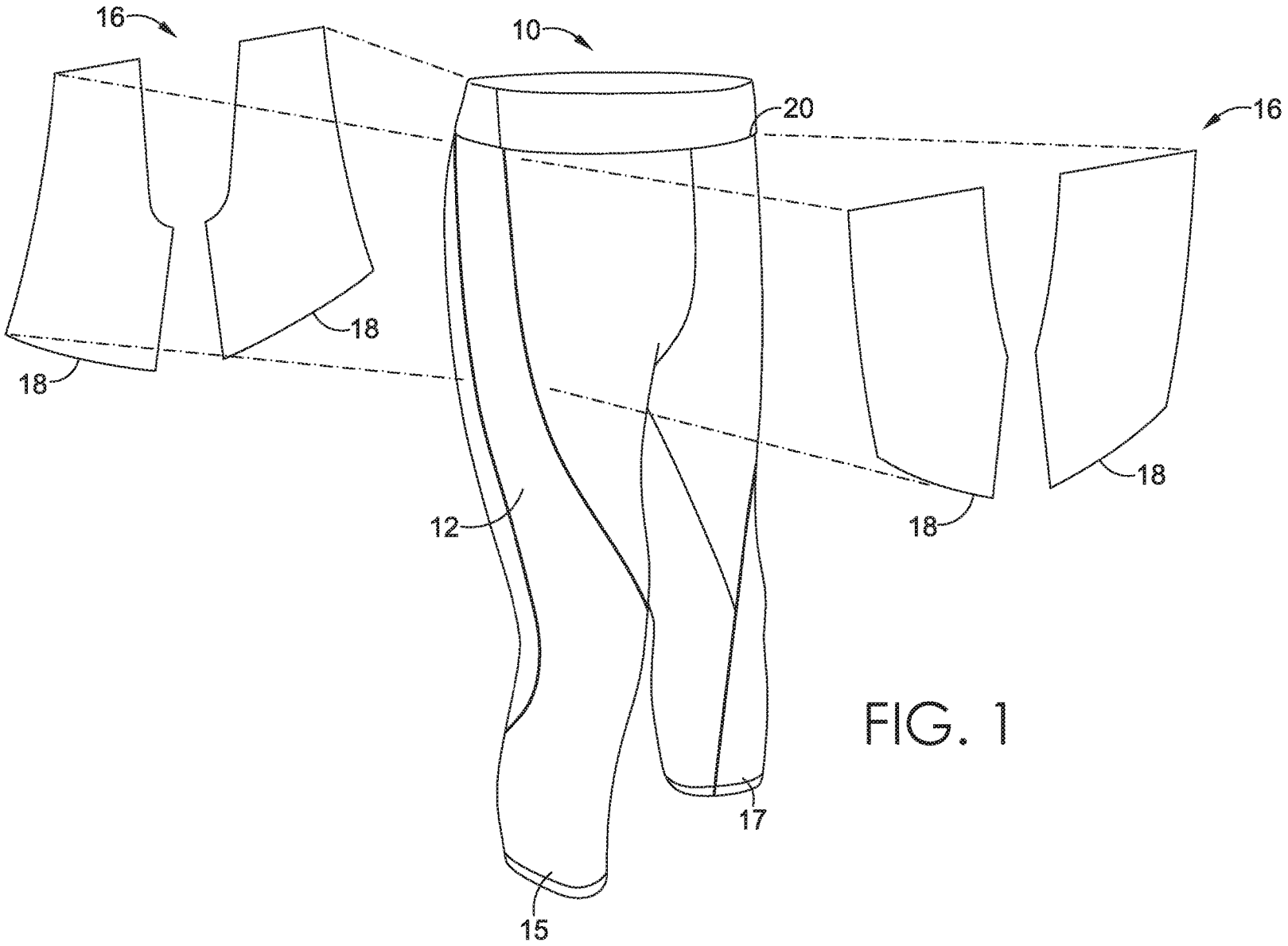
FIG. 1 depicts an exploded perspective view of a hybrid article of apparel, in accordance with an aspect hereof.

The subject matter of various aspects of the present technology is described with specificity in this disclosure to meet statutory requirements. However, the description itself is not intended to limit the scope of the technology. Rather, the claimed subject matter may be embodied or carried out in other ways to include different elements, combinations, components, configurations, and/or steps, including those similar to the ones described in this document, in conjunction with other present or future technologies. Terms such as "step" or "block" should not be interpreted as imparting any order of steps to the methods employed unless such an order is explicitly described and required.

In brief, and at a high level, this disclosure describes, among other things, a hybrid article of apparel that includes a form-fitting inner layer (e.g., a base layer) and a looser and more freely fitting outer layer (e.g., one or more panels of a pair of shorts, pants, etc.) that are coupled together at various locations to provide an aerodynamic article with improved modesty and aesthetics for the wearer, among other benefits. The hybrid article may include various materials, components, and constructions, exemplary aspects of which are described in greater detail below with reference to FIGS. 1-7.

In one exemplary aspect, an article of apparel is provided. The article comprises a first layer forming at least a first leg portion and a second leg portion, and a second layer comprising one or more panel portions, the one or more panel portions secured to the first layer at least at a first lateral area of the first leg portion of the first layer and at a second lateral area of the second leg portion of the first layer.

In another exemplary aspect, an article of apparel is provided. The article comprises a first layer comprising a base layer and forming at least a first leg portion and a second leg portion, and a second layer secured to the first layer, the second layer comprising at least a first panel portion and a second panel portion. The first panel portion is secured to the first layer at least at a first coupling located on a lateral aspect of the first leg portion and a second coupling located on a lateral aspect of the second leg portion. The second panel portion is secured to the first layer at least at a third coupling located on the lateral aspect of the first leg portion and a fourth coupling located on the lateral aspect of the second leg portion. The first coupling is spaced apart from the third coupling to define a first space, and the second coupling is spaced apart from the fourth coupling to define a second space.

In another exemplary aspect, a method of manufacturing an article of apparel is provided. The method comprises providing a first layer comprising a form-fitting base layer having at least a first leg portion and a second leg portion, providing a first panel portion having at least a first lateral edge and a second lateral edge opposite the first lateral edge, and providing a second panel portion having at least a third lateral edge and a fourth lateral edge opposite the third lateral edge. The method further comprises coupling the first lateral edge of the first panel portion and the third lateral edge of the second panel portion to a first lateral area of the first leg portion such that the first lateral edge and the third lateral edge are maintained in a spaced apart relationship, and coupling the second lateral edge of the first panel portion and the fourth lateral edge of the second panel portion to a second lateral area of the second leg portion such that the second lateral edge and the fourth lateral edge are maintained in a spaced apart relationship Referring to FIG. 1, an exploded view of an exemplary hybrid article 10 is provided, in accordance with an aspect hereof. The article 10 comprises a first layer 12, such as a base layer, having at least a torso portion configured to cover a lower torso area of a wearer when the article 10 is worn, a first leg portion 15 configured to cover at least a portion of a first leg (e.g., a right leg) of the wearer when the article 10 is worn, and a second leg portion 17 configured to cover at least a portion of a second leg (e.g., a left leg) of the wearer when the article 10 is worn. In exemplary aspects, the first layer 12 may comprise a relatively form-fitting layer (i.e., a layer that closely conforms to the body contours of a wearer when worn). The article 10 further comprises a second layer 16, which in FIG. 1 comprises a plurality of panels 18 coupled to the first layer 12 at one or more preselected areas. The first layer 12 therefore provides a tighter, more form-fitting part of the article 10 which may impart aerodynamic properties to the article 10, and the second layer 16 provides a looser fitting, more modesty-imparting part of the article 10. In exemplary aspects, the second layer 16 may be coupled to the first layer 12 in such a way that the aerodynamic properties of the first layer 12 are maintained or minimally affected. Although not shown, the article 10 may further comprise additional features such as one or more pockets, enclosures, zippers, and/or attachment features (e.g., clips, hoops, buttons, snaps, rings, lanyards, hook-and-loop fasteners, and the like).

The article 10 further comprises an upper margin 20, at which the first layer 12 and the second layer 16 may be secured to each other. In one aspect, the upper margin 20 may comprise a waistband element (e.g., an integrally formed waistband element or a separately formed waistband element coupled to the upper margin 20) with elastic properties and/or stretch characteristics (e.g., may incorporate stretch-woven or stretch-knitted textile elements). Although generally shown as a three-quarter tight in FIG. 1, it is contemplated herein that the first layer 12 may comprise a short, a pant, and the like exhibiting form-fitting characteristics. Additionally, although generally shown as a pair of shorts, the second layer 16 may comprise at least a portion (e.g., panels thereof) of a looser fitting pant, capris, three-quarter pants, and the like.

The first layer 12, the second layer 16, and any waistband element coupled to the upper margin 20 of the article 10 may comprise one or more stretch or non-stretch woven textiles and/or stretch or non-stretch knitted textiles formed from one or more natural or synthetic yarns, fibers, or filaments. In one exemplary aspect, the first layer 12 may be formed of a stretch-knit textile, and the second layer 16 may be formed of a woven or stretch-woven textile. By having the second layer 16 formed from a woven textile, the intrinsic abrasion-resistance and durability characteristics of woven textiles may help to reduce snagging or wear-and-tear of the first layer 12. However, this is just an example, and it is contemplated herein that both the first layer 12 and the second layer 16 may be formed from a woven textile, both formed from a knit textile, or the first layer 12 formed from a woven textile and the second layer 16 formed from a knit textile. Any and all aspects, and any variation thereof, are contemplated as being within aspects herein.

Continuing, in exemplary aspects, the first layer 12 may comprise a unitary (e.g., seamless) construction. In other words, the first layer may comprise a single piece construction created through, for instance, a knitting or weaving process. In other exemplary aspects, the first layer 12 may be formed through two or more panels coupled together using affixing technologies known in the art such as stitching, bonding, welding, adhesives, and the like. Similarly, the second layer 16 may be formed from a panel of unitary (e.g., seamless) construction or may be formed from two or more panels (e.g., the panels 18) joined together using, for instance, one or more of the affixing technologies described above.

Figure 2B:
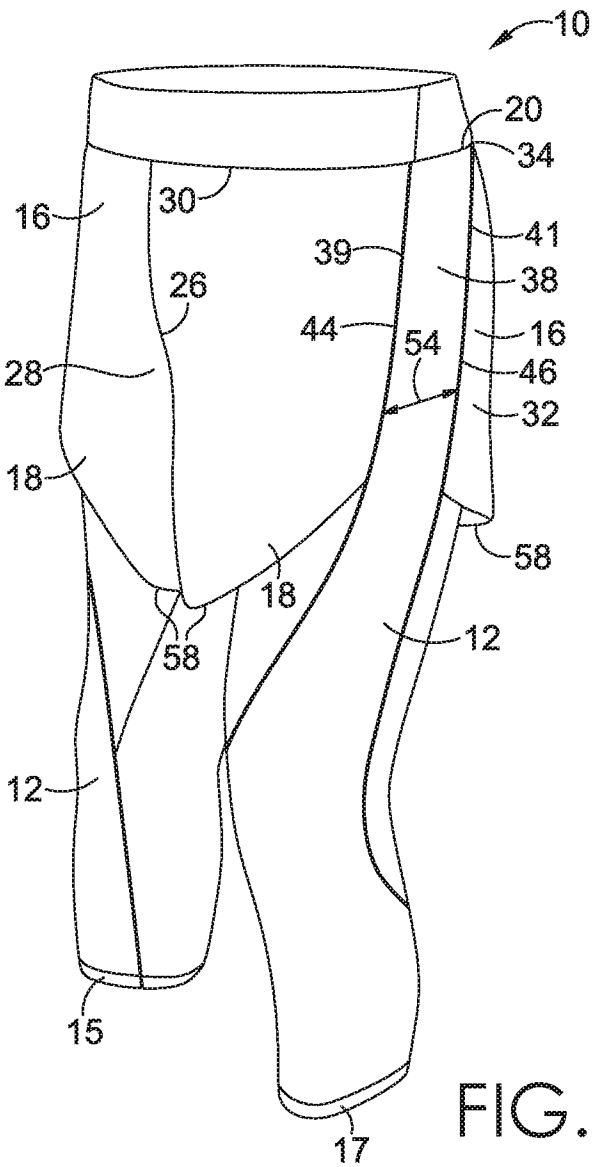
FIG. 2B depicts a left front perspective view of the hybrid article of apparel shown in FIG. 1, in accordance with an aspect hereof.
Figure 2A:
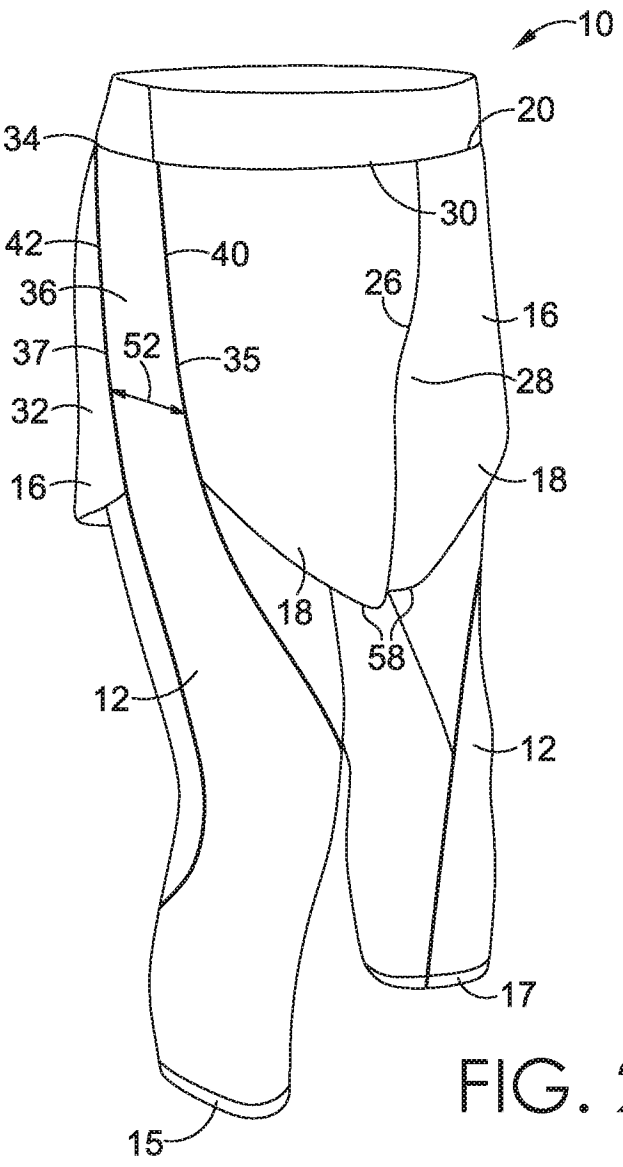
FIG. 2A depicts a right front perspective view of the hybrid article of apparel shown in FIG. 1, in accordance with an aspect hereof.

Referring to FIGS. 2A-2B, first and second perspective views of the article 10 shown in FIG. 1 are provided, in accordance with an aspect hereof. In FIGS. 2A-2B, the article 10 is shown with the second layer 16 (formed from the panels 18) secured to the first layer 12 at one or more predetermined areas. In exemplary aspects, the panels 18 are joined to form a first panel portion 28 coupled to an anterior or front area 30 of the article 10, and a second panel portion 32 coupled to a posterior or rear area 34 of the article 10. The panels 18 forming the first panel portion 28 may be joined together at a first coupling area 26 (e.g., a seam) located at an anterior midline of the article 10. The panels 18 forming the second panel portion 32 may also be joined together at a second coupling area 27 (e.g., a seam; obscured in FIGS. 2A-2B, but depicted in FIG. 5) located at a posterior midline of the article 10.

As shown in FIGS. 2A and 2B, the first panel portion 28 and the second panel portion 32 are secured or coupled to the first layer 12 at a first lateral area 36 of the first leg portion 15 and at a second lateral area 38 of the second leg portion 17. As explained more fully below, the first and second panel portions 28, 32 are secured to the first layer 12 in such a way that the aerodynamic properties of the first layer 12 are generally maintained. As used throughout this disclosure, the term "coupling," "securing," "affixing" and the like may comprise any coupling between two or more textile pieces using, for instance, stitching, bonding, welding, adhesives, and the like.

On one side of the article 10 (e.g., a right side), a first coupling 40 secures a first lateral edge 35 of the first panel portion 28 to the first layer 12 at the first lateral area 36, and a third coupling 42 secures a third lateral edge 37 of the second panel portion 32 to the first layer 12 at the first lateral area 36. As used throughout this disclosure, the term "coupling" as used in phrases such as "a first coupling 40" may comprise a stitched seam line, a welded seam line, a bonded seam line, and the like. On another side of the article 10 (e.g., a left side), a second coupling 44 secures a second lateral edge 39 of the first panel portion 28 to the first layer 12 at the second lateral area 38, and a fourth coupling 46 secures a fourth lateral edge 41 of the second panel portion 32 to the first layer 12 at the second lateral area 38. As mentioned, the couplings 40, 42, 44, 46 joining the first and second layers 12, 16 may include stitching, bonding, one or more adhesives or polymers, and the like, and/or may be ultrasonically welded. Other ways of coupling the first and second panel portions 28, 32 to the first layer 12 are also contemplated herein.

Further shown in FIGS. 2A-2B are first and second spaces 52, 54 formed between the first and second panel portions 28, 32 on the respective first and second lateral areas 36, 38 of the article 10. More particularly, the first space 52 represents the space between the first coupling 40 and the third coupling 42, and the second space 54 represents the space between the second coupling 44 and the fourth coupling 46. In exemplary aspects, the first space 52 comprises an area where a first portion of the first layer 12 is exposed. To put it another way, the first space 52 represents an area where the first and second panel portions 28, 32 are not superimposed on or positioned adjacent to the first layer 12. Similarly, the second space 54 comprises an area where a second portion of the first layer 12 is exposed. To put it another way, the second space 54 represents an area where the first and second panel portions 28, 32 are not superimposed on or positioned adjacent to the first layer 12.

In exemplary aspects, the first space 52 is defined by and extends between the first and third couplings 40, 42. The first space 52 may also be defined by at least the upper margin 20 of the article 10 and by bottom margins 58 of the first and second panel portions 28, 32. In exemplary aspects, the second space 54 is defined by and extends between the second and fourth couplings 44, 46. The second space 54 may also be defined at least by the upper margin 20 of the article 10 and by the bottom margins of the first and second panel portions 28, 32. It should be noted that the first and second spaces 52, 54 may assume different configurations than that shown in FIGS. 2A-2B. It is contemplated herein that a uniform distance or a varied distance may exist between the respective lateral edges 35, 37 and 39, 41 down the respective first and second leg portions 15, 17. For example, the lateral edges 35, 37 of the first lateral area 36 and/or the lateral edges 39, 41 of the second lateral area 38 may each have uniform spacing, tapered spacing, or varied spacing down the respective first and second leg portions 15, 17. Any and all aspects, and any variation thereof, are contemplated as being within the scope herein. It is also contemplated herein that lateral edges, such as the first and third lateral edges 35, 37, or couplings, such as the first and third lateral couplings 40, 42, may be separated by a distance of at least 1 centimeter, at least 2 centimeters, at least 3 centimeters, at least 4 centimeters, at least 5 centimeters, at least 6 centimeters, at least 7 centimeters, at least 8 centimeters, at least 9 centimeters, or at least 10 centimeters, for example, at any point on the first and second lateral areas 36, 38.

As described above, the first and second spaces 52, 54 may represent areas where the first layer 12 is exposed or not covered by the first and second panel portions 28, 32. In another exemplary aspect, the first lateral edge 35 of the first panel portion 28 may be secured directly to the third lateral edge 37 of the second panel portion 32, and the second lateral edge 39 of the first panel portion 28 may be secured directly to the fourth lateral edge 41 of the second panel portion 32. With respect to this aspect, a form-fitting overlay may be positioned on top of the first and second panel portions 28, 32 in the area corresponding to the spaces 52, 54 thus helping to secure the lateral sides of the first and second panel portions 28, 32 to the first layer 12 and helping to maintain the aerodynamic profile of the article 10.

Accordingly, as a result, the article 10 may provide a more streamlined, aerodynamic profile, and at the same time, the second layer 16 may provide a more modesty-imparting portion at the torso portion of the article 10. For instance, an athlete running with a typical short-over-base layer ensemble (e.g., where the short is unaffixed to the base layer) could be distracted by the flapping of the short panels, which may also decrease the aerodynamic profile of the ensemble and slow the athlete down. By ensuring that the lateral areas of the article 10 comprise a form-fitting portion, flapping may be reduced which, in turn, may minimize distractions and may improve the aerodynamic profile of the article 10.

As mentioned, the first and second panel portions 28, 32 further comprise the bottom margin 58, which, in some exemplary aspects, may be angled relative to the upper margin 20 (e.g., may be non-parallel relative to the upper margin 20). Additionally, the couplings 40, 42, 44, 46 may extend to, or terminate at, the bottom margin 58.

As described above, the first layer 12 may be formed of a multiple-panel construction, or rather, from multiple textile portions joined together at different locations. With respect to this aspect, the textile portions may be joined together at various seams or couplings. For instance, the couplings 40, 42, 44, and 46 may extend past the bottom margin 58 of the first and second panel portions 28, 32 as shown in FIGS. 2A and 2B. However, in this respect, they represent locations at which different textile portions of the first layer 12 are joined. Different constructions that allow the first layer 12 to remain more form-fitting and aerodynamic, and the second layer 16 to remain more loosely-fitting and positioned adjacent to an outer-facing surface of the first layer 12, are possible and contemplated herein. Additionally, in various aspects, the number, position, and size of the panels 18 coupled to the first layer 12 may be varied, as may be the number, length, width, size, and location of the couplings 40, 42, 44, and 46 used to connect the second layer 16 to the first layer 12. For instance, instead of two panels 18 for each of the first and second panel portions 28, 32, it is contemplated herein that the first panel portion 28 may be formed from a single panel, and the second panel portion 32 may be formed from a single panel. It is further contemplated herein that instead of the first and second panel portions 28, 32 representing two separate textile portions, a single panel may be utilized for the second layer 16. Any and all aspects, and any variation thereof, are contemplated as being within aspects herein.

Figure 3:
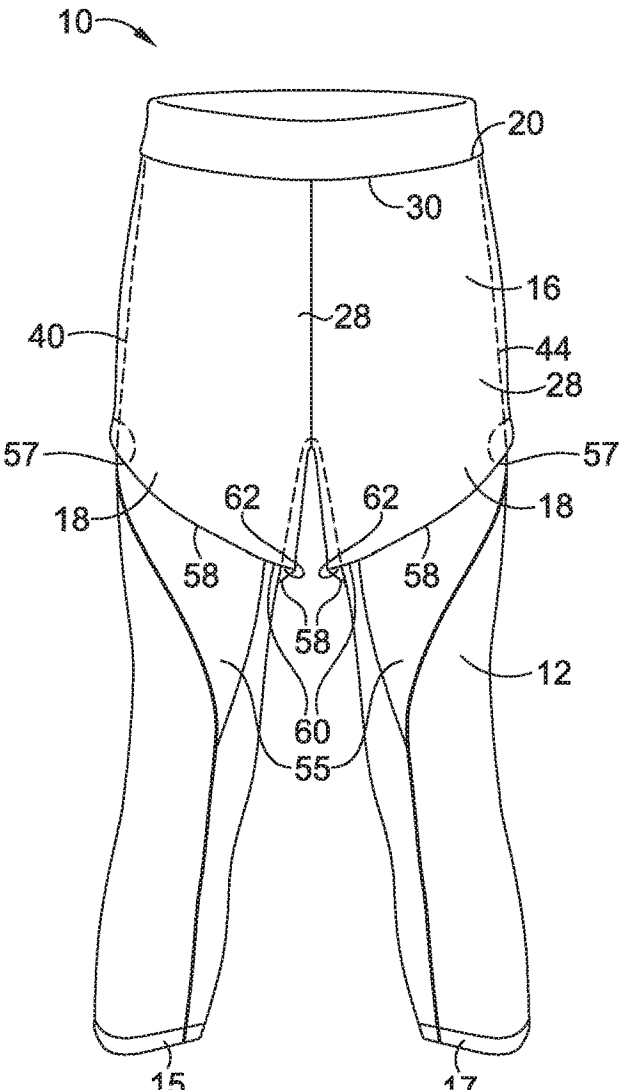
FIG. 3 depicts a front view of the hybrid article of apparel shown in FIGS. 2A-2B, in accordance with an aspect hereof.

Referring to FIG. 3, a front view of the article 10 shown in FIGS. 2A-2B is provided, in accordance with an aspect hereof. In FIG. 3, the portion of the first layer 12 that is located underneath the second layer 16 is depicted with dotted lines, to show where the first layer 12 extends beneath the second layer 16. Additionally, as shown in FIG. 3, the bottom margin 58 of the first and second panel portions 28, 32 may be unaffixed or unsecured to the first layer 12, except at, for instance, the couplings 40, 42, 44, 46. This configuration helps to create an opening 60 into an interior space 62 between the outer-facing surface 55 of the first layer 12 and an inner-facing surface 57 of the second layer 16. The interior space 62 may allow airflow circulation between the first and second layers 12, 16 to allow a cooling effect for the wearer of the article 10 in the crotch and pelvic area. Moreover, by limiting the coupling of the bottom margin 58 of the first and second panel portions 28, 32 to, for instance, the couplings 40, 42, 44, 46, a greater freedom of movement may be imparted to the article 10 when worn.

Figure 4:
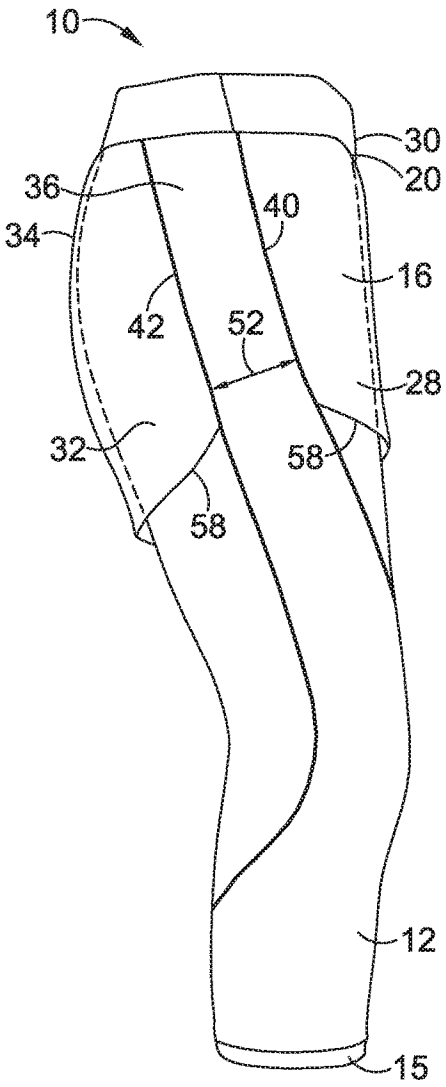
FIG. 4 depicts a right side view of the hybrid article of apparel shown in FIGS. 2A-2B, in accordance with an aspect hereof.

Referring to FIG. 4, a side view of the article 10 shown in FIGS. 2A-2B is provided, in accordance with an aspect hereof. In FIG. 4, the first lateral area 36 of the first leg portion 15 is more directly depicted showing the first space 52 between the first panel portion 28 and the second panel portion 32. The first space 52 is shown generally with an equal or unvarying distance between the first and second couplings 40, 42 (or alternatively between the first and third lateral edges 35, 37) down the first lateral area 36. Alternatively, the distance between the first and second couplings 40, 42 may vary, in accordance with aspects herein. Additionally, as shown, the bottom margin 58 of the first and second panel portions 28, 32 may be provided at different angles relative to the upper margin 20 (e.g., non-parallel relative to the upper margin 20), but may also be parallel to the upper margin 20. Any and all aspects, and any variation thereof, are contemplated as being within the scope herein.

Figure 5:
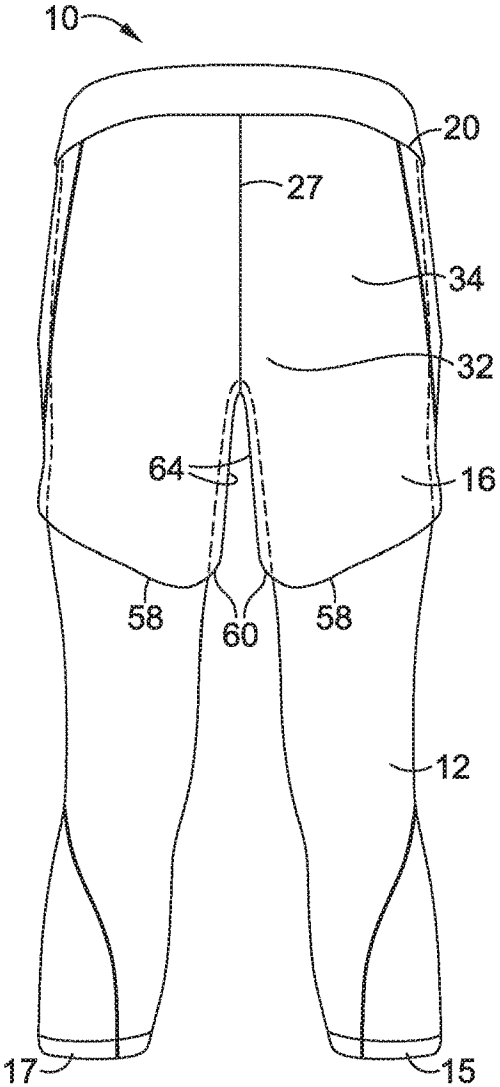
FIG. 5 depicts a rear view of the hybrid article of apparel shown in FIGS. 2A-2B, in accordance with an aspect hereof.

Referring to FIG. 5, a rear view of the article 10 shown in FIGS. 2A-2B is provided, in accordance with an aspect hereof. In addition to the features discussed in relation to FIGS. 1-4, the first panel portion 28 is shown coupled to the second panel portion 32 with at least one crotch seam 64 positioned generally adjacent to a crotch region of the first layer 12. In exemplary aspects, the crotch seam 64 may represent the only point of attachment or connection between the first and second panel portions 28, 32. Alternatively, the second layer 16 may comprise a unitary panel without the crotch seam 64. Additionally, shown in FIG. 5 is the second coupling area 27, as discussed with respect to FIGS. 2A-2B that joins the panels 18 forming the second panel portion 32.

Figure 6B:
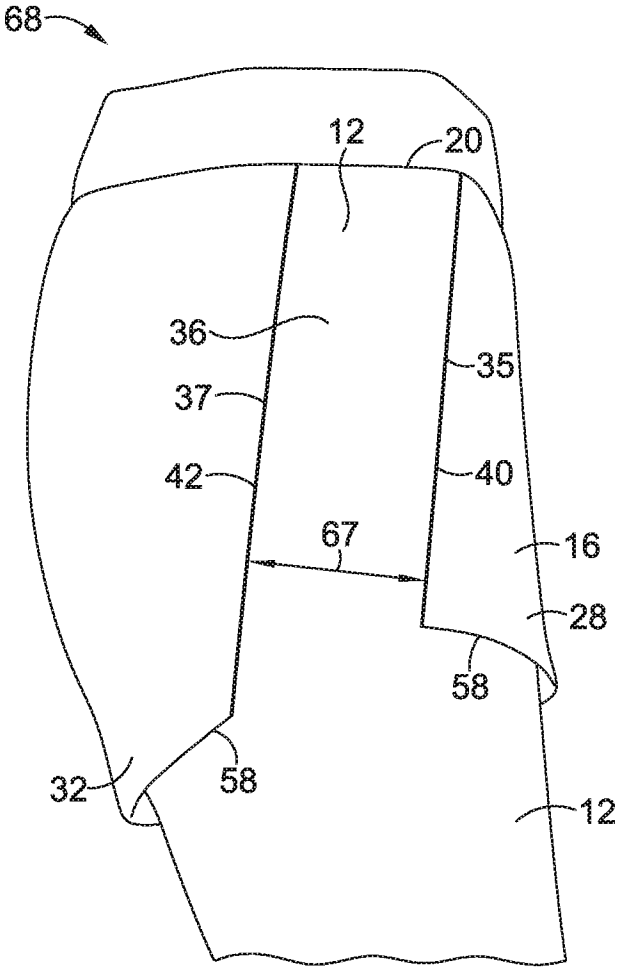
FIG. 6B depicts a side view of a second exemplary lateral area of a hybrid article of apparel, in accordance with an aspect hereof.
Figure 6A:
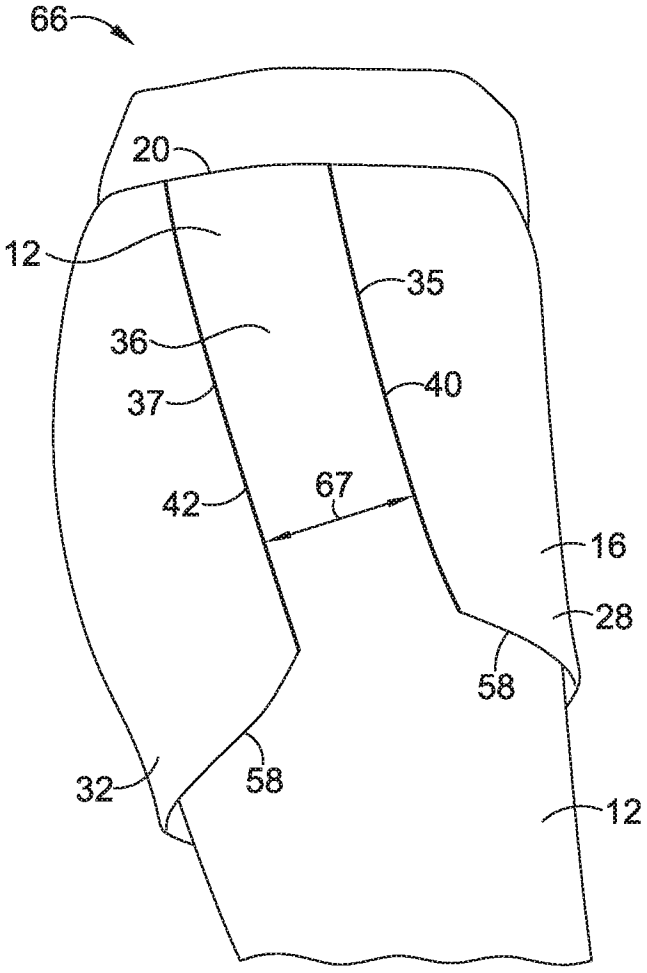
FIG. 6A depicts a side view of a first exemplary lateral area of a hybrid article of apparel, in accordance with an aspect hereof.

Referring to FIGS. 6A-6E, a variety of exemplary configurations 66, 68, 70, 74, 76 for lateral areas of a hybrid article, such as the article 10 shown in FIGS. 1-5, are provided, in accordance with an aspect hereof. It should be noted that for the configurations 66, 68, 70, 74, 76, only one side is depicted in FIGS. 6A-6E, but the configurations 66, 68, 70, 74, 76 may be mirrored on both sides of an article, such as the article 10. FIG. 6A depicts a first configuration 66 in which the first lateral edge 35 of the first panel portion 28 and the third lateral edge 37 of the second panel portion 32 are secured to the first layer 12 by couplings 40 and 42 respectively thereby forming a space 67 between the couplings 40, 42. Additionally, the first and third lateral edges 35, 37 and their respective first and third couplings 40, 42 are angled and non-parallel relative to the upper margin 20, angling towards the front area 30 of the article 10. FIG. 6B depicts a second configuration 68 similar to the first configuration 66, but with the first and third lateral edges 35, 37 and the first and third couplings 40, 42 angling towards the rear area 34 of the article 10 instead of the front area 30.

Figure 6C:
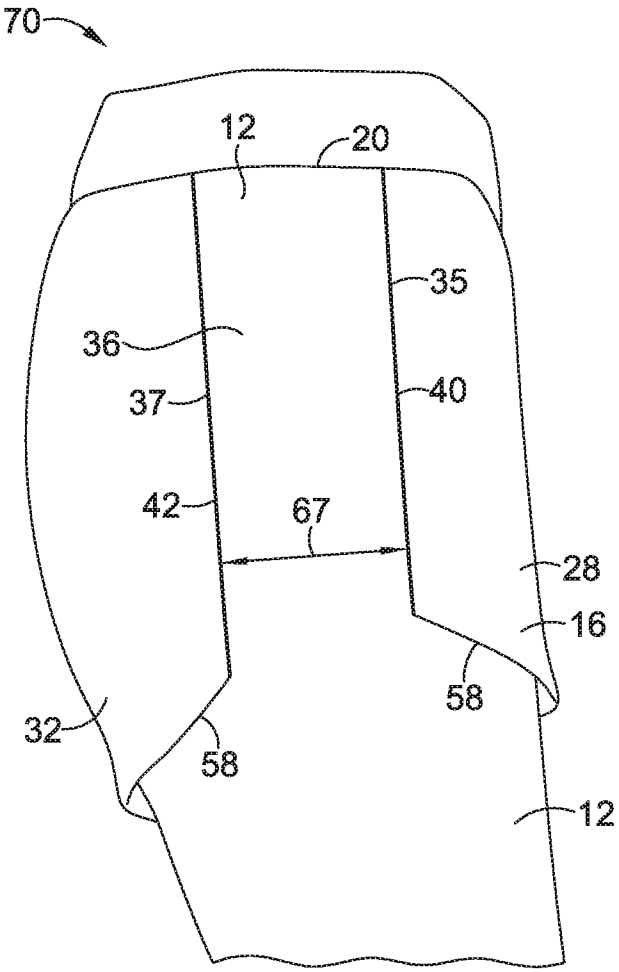
FIG. 6C depicts a side view of a third exemplary lateral area of a hybrid article of apparel, in accordance with an aspect hereof.

FIG. 6C depicts a third configuration 70 similar to FIGS. 6A and 6B, except with the first and third lateral edges 35, 37 and the first and third couplings 40, 42 angled perpendicular relative to the upper margin 20. FIG. 6D depicts a fourth configuration 74 in which the first lateral edge 35 of the first panel portion 28 and the third lateral edge 37 of the second panel portion 32 are separated by a space 75 that is relatively wide compared to the space 67 shown in the first configuration 66 depicted in FIG. 6A. For instance, the space 75 between the first and third lateral edges 35, 37 may be between 5 cm and 25 cm. Additionally, the first and third couplings 40, 42 are angled and non-parallel relative to the upper margin 20.

Figure 6E:
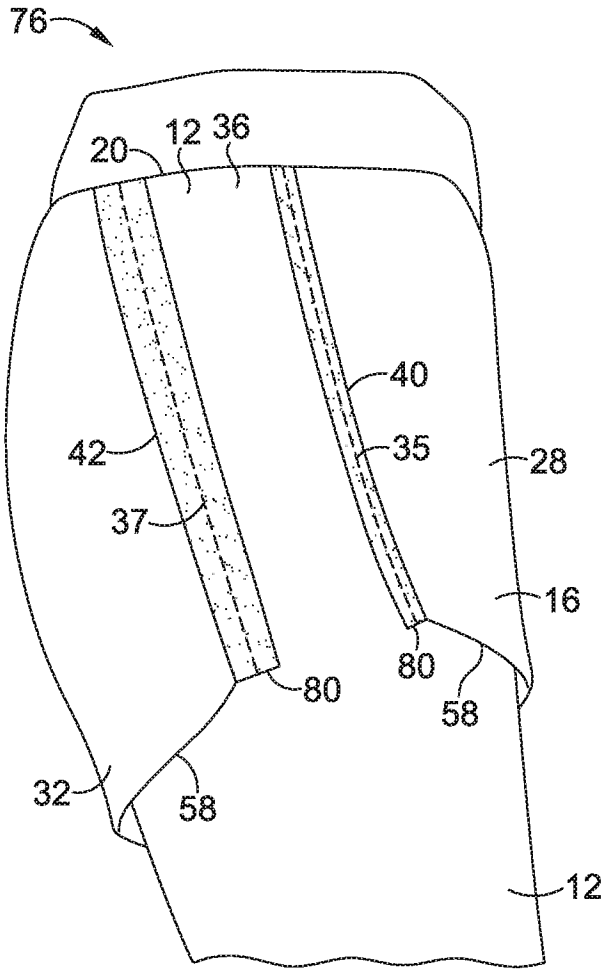
FIG. 6E depicts a side view of a fifth exemplary lateral area of a hybrid article of apparel, in accordance with an aspect hereof.
Figure 6D:
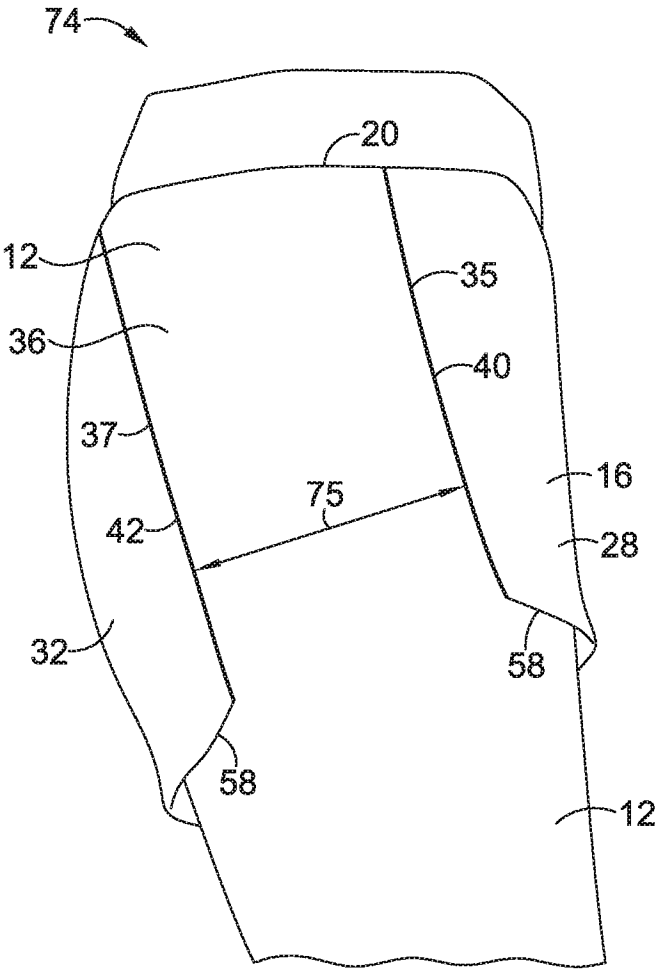
FIG. 6D depicts a side view of a fourth exemplary lateral area of a hybrid article of apparel, in accordance with an aspect hereof.

FIG. 6E depicts a fifth exemplary configuration 76 that is similar to the first configuration 66 shown in FIG. 6A, but with additional reinforcement and/or overlaying material at the first and third couplings 40, 42. This material may comprise, for example, a heat-activated tape 80 (e.g., a heat-activated seam tape), or may be another polymer element, component, or composition that is attached through thermal bonding, ultrasonic bonding, radio frequency bonding, chemical bonding, and the like. In some exemplary aspects, the tape 80 may extend past the bottom margin 58 on the article.

Figure 7:
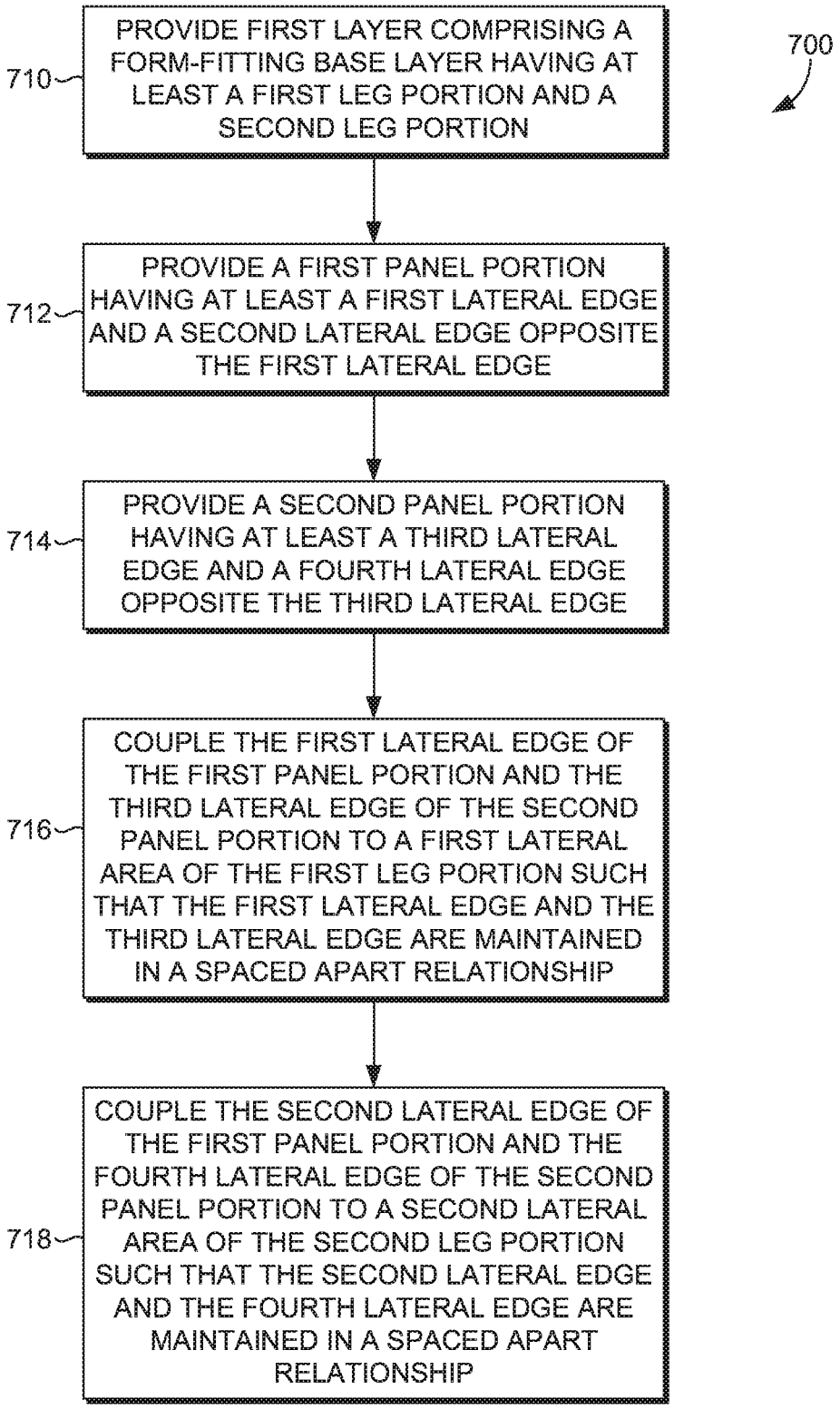
FIG. 7 depicts a block diagram of an exemplary method of manufacturing a hybrid article of apparel, in accordance with an aspect hereof.

Referring to FIG. 7, a block diagram of an exemplary method 700 of manufacturing an article of apparel, such as the article 10 shown in FIGS. 2A-2B, is provided, in accordance with an aspect hereof. At a block 710, a first layer, such as the first layer 12 shown in FIGS. 2A-2B, comprising, for instance, a base layer is provided. In exemplary aspects, the first layer 12 may define, at least in part, a torso portion, a first leg portion, and a second leg portion.

At a block 712, a first panel portion, such as the first panel portion 28 shown in FIGS. 2A-2B, having at least a first lateral edge, such as the first lateral edge 35 shown in FIGS. 2A-2B, and a second lateral edge, such as the second lateral edge 39 shown in FIGS. 2A-2B, opposite the first lateral edge is provided. At a block 714, a second panel portion, such as the second panel portion 32 shown in FIGS. 2A-2B, having at least a third lateral edge, such as the third lateral edge 37 shown in FIGS. 2A-2B, and a fourth lateral edge, such as the fourth lateral edge 41 shown in FIGS. 2A-2B, opposite the third lateral edge is provided.

At a block 716, the first lateral edge of the first panel portion and the third lateral edge of the second panel portion are each coupled to the first layer at a lateral area of the first leg portion, such as the first lateral area 36 shown in FIGS. 2A-2B, such that the first lateral edge and the third lateral edge are maintained in a spaced apart relationship. At a block 718, the second lateral edge of the first panel portion and the fourth lateral edge of the second panel portion are each coupled to the first layer at a lateral area of the second leg portion, such as the second lateral area 38 shown in FIGS. 2A-2B, such that the second lateral edge and the fourth lateral edge are maintained in a spaced apart relationship.

From the foregoing, it will be seen that the technology described in this disclosure is well adapted to attain all the ends and objects hereinabove set forth together with other advantages which are obvious and which are inherent to the structure. It will be understood that certain features and sub-combinations are of utility and may be employed without reference to other features and sub-combinations. This is contemplated by and is within the scope of the claims. Since many possible aspects of the technology are possible without departing from the scope thereof, it is to be understood that all matter herein set forth or shown herein and in the accompanying drawings is to be interpreted as illustrative and non-limiting.

The invention claimed is:

1. An article of apparel, comprising:

a first layer comprising at least a first form-fitting leg portion and a second form-fitting leg portion that together define a pair of tights, the first form-fitting leg portion adapted to encompass a first leg of a wearer when in an as-worn configuration, the second form-fitting leg portion adapted to encompass a second leg of the wearer when in the as-worn configuration; and a second layer comprising a first front panel, a second front panel, a first back panel, and a second back panel, the first front panel and the second front panel coupled along an anterior midline of the article of apparel, wherein the first front panel and the second front panel together comprise a first panel portion, the first back panel and the second back panel coupled along a posterior midline of the article of apparel, wherein the first back panel and the second back panel together comprise a second panel portion, the first panel portion and the second panel portion directly coupled between the first form-fitting leg portion and the second form-fitting leg portion thereby forming at least in part a pair of shorts having a first leg opening and a second leg opening, the first leg opening circumscribing at least a front, a back, and a medial side of the first form-fitting leg portion, and the second leg opening circumscribing at least a front, a back, and a medial side of the second form-fitting leg portion, a first edge of the first panel portion secured to the first layer at a first location in a first lateral area of the first form-fitting leg portion of the first layer, a first edge of the second panel portion secured to the first layer at least at a second location in the first lateral area such that a first gap is formed between the first panel portion and the second panel portion in the first lateral area, wherein the first layer is exposed in the first gap, a second edge of the first panel portion secured to the first layer at a first location in a second lateral area of the second form-fitting leg portion of the first layer, a second edge of the second panel portion secured to the first layer at a second location in the second lateral area of the second form-fitting leg portion of the first layer such that a second gap is formed between the first panel portion and the second panel portion in the second lateral area, wherein the first layer is exposed in the second gap, wherein each of the first front panel, the second front panel, the first back panel, and the second back panel comprises an upper margin terminating at a waistband of the article of apparel, wherein the first panel portion and the second panel portion are coupled together with a crotch seam, and wherein the first form fitting leg portion and the second form-fitting leg portion each comprise a stretch characteristic.

2. The article of apparel of claim 1, wherein each of the first front panel, the second front panel, the first back panel, and the second back panel is secured to the waistband of the article of apparel.

3. The article of apparel of claim 2, wherein the first edge of the first panel portion, is secured to the first layer from the waistband of the article of apparel to a bottom margin of the first panel portion, wherein the second edge of the first panel portion is secured to the first layer from the waistband of the article of apparel to the bottom margin of the first panel portion, wherein the first edge of the second panel portion is secured to the first layer from the waistband of the article of apparel to a bottom margin of the second panel portion, and wherein the second edge of the second panel portion is secured to the first layer from the waistband of the article of apparel to the bottom margin of the second panel portion.

4. The article of apparel of claim 3, wherein the bottom margin of the first panel portion and the bottom margin of the second panel portion are at least partially uncoupled from the first layer to define an opening to a space formed between an outer-facing surface of the first layer and an inner-facing surface of the second layer.

5. The article of apparel of claim 1, wherein the second layer is secured to the first layer at the first lateral area of the first form-fitting leg portion and at the second lateral area of the second form-fitting leg portion with heat-activated tape, wherein, at the first lateral area and at the second lateral area, the heat-activated tape extends from an upper margin of the second layer to a bottom margin of the second layer.

6. A method of manufacturing an article of apparel, the method comprising:

forming a first layer comprising a first form-fitting leg portion and a second form-fitting leg portion that together define a pair of tights, the first form-fitting leg portion adapted to encompass a first leg of a wearer when in an as-worn configuration, and the second form-fitting leg portion adapted to encompass a second leg of the wearer when in the as-worn configuration;

forming a first panel portion by coupling a first front panel to a second front panel along an anterior midline, the first panel portion having at least a first lateral edge and a second lateral edge opposite to the first lateral edge;

forming a second panel portion by coupling a first back panel to a second back panel along a posterior midline, the second panel portion having at least a third lateral edge and a fourth lateral edge opposite to the third lateral edge;

coupling the first lateral edge of the first panel portion and the third lateral edge of the second panel portion to a first lateral area of the first form-fitting leg portion such that the first form-fitting leg portion is exposed in a first gap between the first lateral edge and the third lateral edge;

coupling the second lateral edge of the first panel portion and the fourth lateral edge of the second panel portion to a second lateral area of the second form-fitting leg portion such that the second form-fitting leg portion is exposed in a second gap between the second lateral edge and the fourth lateral edge;

coupling each of the first front panel, the second front panel, the first back panel, and the second back panel to a waistband of the article of apparel such that upper margins of each of the first front panel, the second front panel, the first back panel, and the second back panel terminate at the waistband; and coupling the first panel portion to the second panel portion between the first form-fitting leg portion and the second form-fitting leg portion by forming a crotch seam, thereby forming at least in part a pair of shorts having a first leg opening and a second leg opening, the first leg opening circumscribing at least a front, a back, and a medial side of the first form-fitting leg portion, and the second leg opening circumscribing at least a front, a back, and a medial side of the second form-fitting leg portion, wherein the first form fitting leg portion and the second form-fitting leg portion each comprise a stretch characteristic.

7. The method of manufacturing the article of apparel of claim 6, wherein the first, second, third, and fourth lateral edges are each secured to the first layer using a heat-activated tape.

8. The article of apparel of claim 1, wherein the first form-fitting leg portion and the second form-fitting leg portion each extend further from an upper margin of the article of apparel than the one or more panel portions.

9. The article of apparel of claim 1, wherein the first layer is formed of a unitary construction.

10. The method of manufacturing the article of apparel of claim 6, wherein the forming the first layer comprises forming the first layer of a unitary construction.

* * * * *